US006414655B1

(12) United States Patent
Morimoto

(10) Patent No.: US 6,414,655 B1
(45) Date of Patent: Jul. 2, 2002

(54) PLASMA ADDRESS DISPLAY APPARATUS AND CONSTANT-CURRENT CONTROL APPARATUS

(75) Inventor: Takashi Morimoto, Nara-ken (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/336,762

(22) Filed: Jun. 21, 1999

(30) Foreign Application Priority Data

Jun. 22, 1998 (JP) ..... 10-174256
Jun. 18, 1999 (JP) ..... 11-173359

(51) Int. Cl.[7] ..... G09G 3/28
(52) U.S. Cl. ..... 345/60; 345/87; 345/211
(58) Field of Search ..... 345/60, 61, 62, 345/63, 64, 66, 67, 68, 69, 87, 211, 212, 213; 315/169.1, 169.2, 169.4

(56) References Cited

U.S. PATENT DOCUMENTS 4,755,768 A * 7/1988 Shimokawa ..... 330/290
5,408,245 A * 4/1995 Kakizaki ..... 345/60
5,554,973 A * 9/1996 Kawashima et al. ..... 340/562
5,696,522 A * 12/1997 Iwama ..... 345/60
5,896,008 A * 4/1999 Hayashi ..... 345/60

FOREIGN PATENT DOCUMENTS

JP 8-313883 A 11/1996

* cited by examiner

*Primary Examiner*—Xiao Wu
(74) *Attorney, Agent, or Firm*—Nixon & Vanderhye P.C.

(57) ABSTRACT

A plasma address display apparatus of the present invention includes: a plasma substrate on which a plurality of plasma chambers are arranged in rows, the plasma chambers including at least an anode electrode and a cathode electrode; an opposite substrate on which a plurality of signal electrodes are arranged in columns; and a liquid crystal layer provided between the plasma substrate and the opposite substrate, wherein the plurality of plasma chambers are selectively discharged and a desired data voltage is selectively applied to the plurality of signal electrodes, whereby a desired display is performed, the apparatus further comprising a discharge current control circuit for switching a discharge current flowing through the plasma chambers to at least three values of a first discharge current at the commencement of plasma discharge, a second discharge current immediately before the finish of plasma discharge, and a third discharge current after the finish of plasma discharge.

9 Claims, 10 Drawing Sheets

PLASMA ADDRESS DISPLAY APPARATUS AND CONSTANT-CURRENT CONTROL APPARATUS

BACKGROUND OF THE INVENTION

1. Field of the Invention

The present invention relates to a plasma address display apparatus for selectively controlling a pixel by using a plasma switch and a constant-current control apparatus for use in the plasma address display apparatus.

2. Description of the Related Art

As a flat display apparatus, a liquid crystal display apparatus has already been put into practical use in a number of fields, and enlargement of the liquid crystal display apparatus has been actively developed. In order to allow a liquid crystal display apparatus to have a high resolution and a high contrast, a method for providing an active element such as a transistor in each display pixel and driving it is generally used. However, when it is attempted to enlarge a liquid crystal display apparatus, the number of active elements is remarkably increased, which results in a decrease in a production yield.

In order to solve the above-mentioned problem, Japanese Laid-Open Publication No. 1-217396 discloses a method utilizing plasma discharge, instead of semiconductor elements such as MOS transistors and thin film transistors. Hereinafter, a structure of a liquid crystal display apparatus in which liquid crystal is driven by utilizing plasma discharge (hereinafter, referred to as a "plasma address display apparatus) will be briefly described.

As shown in FIG. 7, in a plasma address display apparatus, a liquid crystal layer 103 which is an electrooptical material layer and plasma chambers $P_1$ to $P_n$ are disposed adjacent to each other via a thin dielectric sheet 104. Each of the plasma chambers $P_1$ to $P_n$ is surrounded by partition walls 105 parallel to each other and the dielectric sheet 104 on a plasma substrate 102. In each plasma chamber, ionizable gas such as He, Ne, Ar, Kr, and Xe, or mixed gas thereof is sealed. Furthermore, electrodes 106 are formed in each plasma chamber on the plasma substrate 102, and the electrodes 106 function as an anode electrode and a cathode electrode for ionizing gas in each plasma chamber to generate plasma discharge.

On the other hand, the liquid crystal layer 103 is interposed between the dielectric sheet 104 and a transparent substrate 101, and the periphery of the liquid crystal layer 103 is sealed with a sealant 108. On the surface of the transparent substrate 101 on the liquid crystal layer side, stripe-shaped signal electrodes 107 are formed. The signal electrodes 107 cross the plasma chambers $P_1$ to $P_n$, and each crossed portion of the signal electrodes 107 and the plasma chambers $P_1$ to $P_n$ correspond to each display pixel.

In the plasma address display apparatus, the plasma chambers $P_1$ to $P_n$ in which plasma is discharged are scanned successively in this order, and in synchronization with this, the signal electrodes 107 on the liquid crystal layer 103 side are supplied with a signal voltage, whereby the signal voltage is held by each pixel, and the liquid crystal layer 103 is driven. Thus, each of the plasma chambers $P_1$ and $P_n$ correspond to one scanning line. The adjacent plasma chambers of the plasma chambers $P_1$ to $P_n$ are separated by a partition wall.

FIG. 8 schematically shows a pixel. In FIG. 8, reference 110 denotes an anode electrode, 111 denotes a cathode electrode, 112 denotes a plasma switch operated by plasma discharge, and 113 denotes a signal electrode. The plasma switch 112 is turned on when a desired voltage is applied to the cathode electrode 111, and is turned off when the voltage of the cathode electrode 111 becomes equal to that of the anode electrode 110.

A capacitor $C_t$ corresponds to a capacitance of the dielectric sheet 104 in FIG. 7, and a capacitor $C_{LC}$ corresponds to a capacitance of the liquid crystal layer 103 in FIG. 7. By applying a desired voltage to the signal electrode 113 when the plasma switch 112 is turned on, an voltage between the anode electrode 110 and the signal electrode 113 is divided by the capacitors $C_t$ and $C_{CL}$, and a desired voltage is applied to the liquid crystal layer 103. If the plasma switch 112 is turned off in this state, the voltage applied to the liquid crystal layer 103 is held until the plasma switch 112 is turned on again.

FIG. 9 is a schematic circuit diagram of a plasma address display apparatus. In this figure, each pixel pix is further simplified, compared with FIG. 5.

A plurality of pixels are arranged in a matrix. Anode electrodes 120 and cathode electrodes 121 are arranged in rows, and signal electrodes $VL_1, VL_2, \ldots, VL_n$ are arranged in columns. The anode electrodes 120 are commonly fixed at the identical voltage, and the cathode electrodes 121 are independently connected to switches $S_1, S_2, \ldots, S_n$. The switches $S_1, S_2, \ldots, S_n$ are for switching an voltage of the cathode electrodes 121.

Next, driving of the plasma address display apparatus will be briefly described.

Under the condition that plasma discharge is not generated, the dielectric sheet 104 is electrically insulated from the anode electrode 120 and the cathode electrode 121. When an voltage which is negative to the anode electrode 120 is applied to the cathode electrode 121, plasma discharge is generated.

Due to the plasma discharge, space charges of ions and electrons is generated in the plasma chamber, whereby the voltage in the plasma chamber becomes equal to that of the anode electrode 120. At this time, the voltage of the lower surface of the dielectric sheet 104 becomes equal to that of the anode electrode 120, which means that a virtual electrode is formed. When a data voltage is applied to the signal electrode 107 based on the voltage of the anode electrode 120, the data voltage is divided in accordance with a ratio between the capacitance of the dielectric sheet 104 and that of the liquid crystal layer 103. As a result, desired data is written in a display pixel.

When the voltage of the cathode electrode 121 is returned to be equal to that of the anode electrode 120, the plasma discharge is finished. After the plasma discharge is finished, the space charges are decayed gradually, and the plasma chamber returns to an insulated state. This state is the same as the state where the plasma switch 112 is turned off, and a voltage is not applied to the liquid crystal layer 103. However, the charge accumulated on the surface of the dielectric sheet 104 is held in the liquid crystal until the subsequent discharge is generated. Because of this operation, a sample-and-hold drive which is similar to that of a liquid crystal apparatus using ordinary active elements is conducted.

It is more advantageous in terms of desirably writing data in a pixel that the data voltage applied to the signal electrode 107 continues to be applied until the plasma chamber returns to an insulated state. However, as the period of applying a data voltage is extended, crosstalk in the vertical direction becomes more likely to occur. This is a trade-off relationship. Thus, the applied voltage is reset slightly before the plasma chamber returns to an insulated state. As a result, the charge held in the liquid crystal layer 103 is slightly changed; however, this change is suppressed to such a degree that no substantial problem arises.

Among the space charges, some particles are excited in a metastable state, and thereafter, returns to the basic state. Therefore, even after the plasma discharge is finished, such metastable atoms remain for a relatively long period of time, and generate a trace amount of paired ions and electrons. Thus, the plasma switch 112 holds a conductive state for a while after the finish of the plasma discharge. The plasma switch 112 returns to a non-conductive state only when the metastable atoms substantially completely return to the basic state. Therefore, the charge eventually written in each display pixel depends upon a decay time $\tau 1$ from the time when the plasma discharge is finished to the time when the metastable atoms return to the basic state.

However, the above-mentioned decay time is required to be at least shorter than a period from the time when plasma discharge in a plasma chamber $P_k$ is finished to the time when plasma discharge in the subsequent plasma chamber $P_{K+1}$ is started. In particular, a selection period assigned to one scanning line becomes shorter with the advancement of high resolution, so that it becomes more necessary to shorten the decay time. The selection period assigned to one scanning line is about 32 $\mu$s, for example, in a VGA-grade panel. However, the selection period is about 15 $\mu$s in a high-definition TV.

Moreover, if the decay time can be shortened, a data voltage applied during the selection period can be reset in earlier time, which makes it possible to shorten the apply period of a data voltage. Thus, there is an increased demand for shortening the decay time. Herein, a period from the time when plasma discharge is finished to the time when a data voltage applied to the signal electrode is reset is defined as a "decay time of decay voltage".

Japanese Laid-Open Publication No. 8-313883 discloses a plasma address display panel, in which in addition to He, Ne, Ar, Kr, Xe, or the like, or mixed gas thereof sealed in plasma chambers, trace amounts of the other components are contained therein, whereby the decay time can be readjusted.

However, according to the technique disclosed in Japanese Laid-Open Publication No. 8-313883, a gas component ratio in each plasma chamber is changed every time the decay time is adjusted, which requires confirmation of reliability such as blackening. Furthermore, once gas is sealed in the plasma chambers, it is impossible to readjust the decay time. Still furthermore, it is very difficult to control amounts of components to be added so as to obtain a desired decay time.

SUMMARY OF THE INVENTION

A plasma address display apparatus, includes: a plasma substrate on which a plurality of plasma chambers are arranged in rows, the plasma chambers including at least an anode electrode and a cathode electrode; an opposite substrate on which a plurality of signal electrodes are arranged in columns; and a liquid crystal layer provided between the plasma substrate and the opposite substrate, wherein the plurality of plasma chambers are selectively discharged and a desired data voltage is selectively applied to the plurality of signal electrodes, whereby a desired display is performed, the apparatus further including a discharge current control circuit for switching a discharge current flowing through the plasma chambers to at least three values of a first discharge current at the commencement of plasma discharge, a second discharge current immediately before the finish of plasma discharge, and a third discharge current after the finish of plasma discharge.

By switching the discharge current, a decay time can be shortened. In particular, by suppressing the second discharge current, it becomes possible to shorten the time for decaying space charges after the finish of plasma discharge, and to further shorten the decay time.

In one embodiment of the present invention, the discharge current control circuit has at least one constant-current circuit, and the discharge current is controlled by using the at least one constant current circuit.

In another embodiment of the present invention, the discharge current is controlled by controlling a voltage applied to the cathode electrodes.

In another embodiment of the present invention, the discharge current control circuit controls a waveform of the discharge current in the plasma chambers in the form of steps.

In another embodiment of the present invention, the discharge current control circuit controls a waveform of the discharge current in the plasma chambers in the form of slopes.

In another embodiment of the present invention, a timing at which a desired data voltage starts being applied to the signal electrodes comes before a timing at which a plasma chamber where pixels for writing the data voltage are switched starts being discharged. Because of this, it becomes possible to write a data voltage in each pixel at a high speed, and to shorten the time required for writing the data voltage. Particularly, in the case where the decay time is controlled, and a selected plasma chamber can be set in an insulated state before the completion of a selection period, even when the timing at which a data voltage is applied to the signal electrodes comes before the timing at which a selection period of a pixel for writing the data voltage starts, the data voltage is not written in a pixel in the previous row. Therefore, the above-mentioned structure is particularly useful.

A constant-current control apparatus of the present invention includes a plurality of constant-current circuits having control terminals which are independent from each other, wherein sink current terminals of the constant-current circuits are commonly connected, and each of the control terminals is independently controlled.

A constant-current control apparatus of the present invention includes a current mirror circuit having first and second transistors whose bases are connected to each other, in which an emitter of each of the first and second transistors is connected to a first power supply line through first and second resistors, and a collector of the second transistor is connected to the base of the second transistor, wherein third and fourth resistors having different resistances are connected in parallel to the base of the second transistor in the current mirror circuit, and an voltage applied to the third and fourth resistors is controlled, whereby a collector current of the first transistor in the current mirror circuit is controlled.

As described above, the discharge current can also be controlled by using the current mirror circuit. In this case, by providing a sufficient difference in resistance between the third and fourth resistors, in the case where a "HIGH" signal is applied to both the third and fourth resistors, the current mirror circuit can be controlled, giving a priority to a signal with a low resistance.

In one embodiment of the present invention, a capacitance component is provided between the base of the second transistor and the first power supply line.

Thus, the invention described herein makes possible the advantages of (1) providing a plasma address display apparatus capable of adjusting a decay time by a simpler method; and (2) providing a constant-current control apparatus for use in the plasma address display apparatus.

These and other advantages of the present invention will become apparent to those skilled in the art upon reading and understanding the following detailed description with reference to the accompanying figures.

DESCRIPTION OF THE PREFERRED EMBODIMENTS

Hereinafter, the terms used related to the present invention will be explained.

The term "address" generally refers to a location where data is to be written in a memory device. When data is written in the memory device, it is required to specify an address. In general, data to be written in the memory device is digital data.

In a plasma address display apparatus, a plurality of pixels arranged in a row are selected, and a pixel signal is written in each of the selected plurality of pixels. A pixel signal to be written in a pixel may be a digital signal or an analog signal.

In the plasma address display apparatus, an addressing operation is started by generating a plasma discharge in the selected row and the addressing operation is ended by, after the plasma discharge is finished in the selected row, substantially decaying paired charges (ions and electrons) generated by the plasma discharge so that the ratio of a write error (which has the same meaning as that of a writing error) becomes a predetermined value or less. The scanning period assigned to one row is restricted by a broadcast system, so that the term "selection period" has the same meaning as that of one horizontal scanning period or address period.

Figure 1:
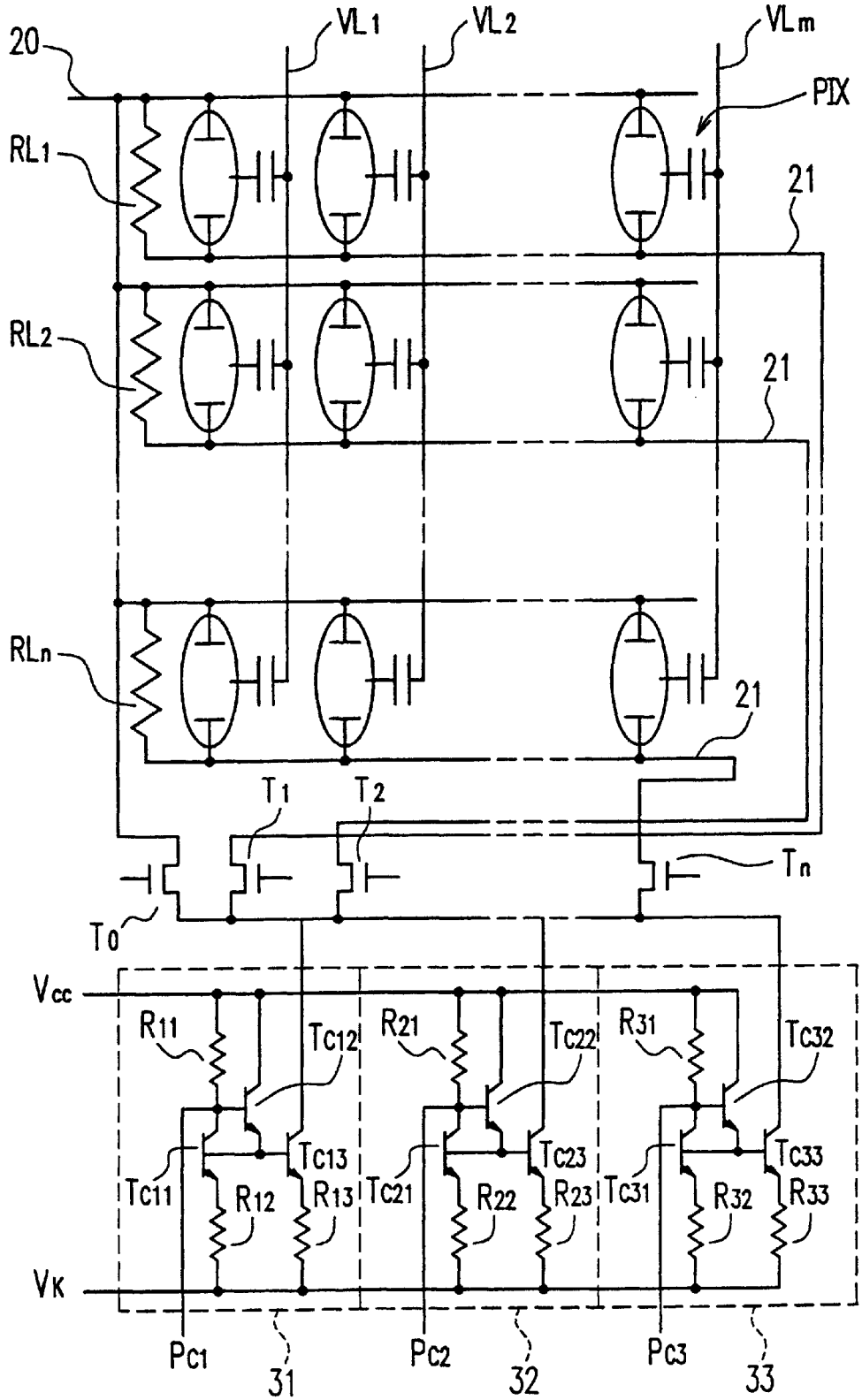
FIG. 1 is a schematic circuit diagram of a plasma address display apparatus of the present invention.

The term "selection" refers to selectively turning on any one of the gates of switching transistors $T_1$ to $T_n$ shown in FIG. 1, for example.

In a narrow sense, the term "write" refers to sampling a charge corresponding to a pixel signal into a capacitor $C_t$ and a capacitor $C_{LC}$ during a period from the time when the plasma discharge is started to the time when a signal voltage is reset to a voltage in a range of a blanking level to a black level. This period refers to a "sampling period". The signal voltage apply period is divided into a reset period and a set period. In the same way as this, the sampling period can be divided into a period of sampling a reset signal and a period of sampling a set signal. The period of sampling a reset signal may be eliminated.

In the present specification, a writing error is described in terms of "is not written" and the like. The writing error includes a sampling error and a decay voltage.

The sampling error is a difference between a signal voltage and a sampled voltage during a sampling period. Generally, a ratio of the difference between the sampling output and the expected sampling output to the expected sampling output is called a linear error.

The decay voltage has the same meaning as that of a hold error which is caused by recombination of one of paired charges (ions and electrons) and a sampled charge in the process where the paired charges generated by the plasma discharge are decayed during a period from the time when signal voltages for a row is reset to the time when the row is selected again (i.e., one vertical scanning period or hold period). Alternatively, the decay voltage is a term which is similar to a droop voltage used in relation to a sample-and-hold circuit.

A decay period has a value determined in accordance with the broadcast system, the number of pixels in a vertical direction, etc., whereas a decay time has a value depending upon the kind of gas sealed in plasma chambers. The term "decay time of decay voltage" used herein has a meaning closer to the decay time rather than the decay period.

Embodiment 1

Embodiment 1 of the present invention will be described with reference to FIG. 1.

FIG. 1 shows an example of a schematic circuit configuration of a plasma address display apparatus of the present invention. In this figure, each pixel PIX is further simplified, compared with FIG. 5.

A plurality of pixels are arranged in a matrix. Anode electrodes 20 and cathode electrodes 21 are arranged in rows, and signal electrodes $VL_1, VL_2, \ldots, VL_n$ are arranged in columns.

The anode electrodes 20 are commonly fixed at the identical voltage. The cathode electrodes 21 are independently connected to switching transistors $T_1, T_2, \ldots, T_n$, and connected to an voltage identical with that of the anode electrodes 20 via load resistors $RL_1, RL_2, \ldots, RL_n$. The other terminals of the switching transistors $T_1, T_2, \ldots, T_n$ are all commonly connected.

On the other hand, in a driving circuit for the cathode electrodes 21, a discharge current control circuit including three constant-current circuits 31, 32, and 33 is provided, and each constant-current circuit is connected to the commonly connected switching transistors $T_1, t_2, \ldots, T_n$. In order to prevent NPN transistors $T_{C13}$,$T_{C23}$, and $T_{C33}$ in each constant-current circuit from being saturated in the case where all the switching transistors are turned off, each constant-current circuit is bypassed to the anode electrodes 20 via the switching transistor $T_0$.

The constant-current circuits 31, 32, and 33 have independent input terminals $P_{C1}$, $P_{C2}$, and $P_{C3}$. By independently controlling the input terminals $P_{C1}$, $P_{C2}$, and $P_{C3}$, a sink current from each cathode electrode 21 can be varied.

The operation of each constant-current circuit will be described, exemplifying the constant-current circuit 31.

The constant-current circuit 31 has three resistors $R_{11}$, $R_{12}$, and $R_{13}$ and three NPN transistors $T_{C11}$, $T_{C12}$, and $T_{C13}$. The constant sink current circuit 31 is controlled by a signal $P_{C1}$ input to a base of the NPN transistor $T_{C12}$. $V_{CC}$ and $V_X$ are held at predetermined voltages, respectively. For example, $V_K$ is held at about −380 to −450 volts based on the voltage of the anode electrodes 20, and $V_{CC}$ is held at about 5 to 12 volts based on $V_X$.

A level $I_{D1}$ of a sink current when the constant-current circuit 31 is turned on is represented by Formula 1.

$$I_{D1} = \frac{V_{CC} - V_K - 2V_{BE}}{R_{11} + R_{12}} \times \frac{R_{12}}{R_{13}} \tag{1}$$

where $V_{D3}$ denotes a forward voltage between the base and the emitter of the NPN transistor $T_{C11}$.

This also applies to the constant-current circuits 32 and 33. A plasma discharge current $I_D$ is represented by Formula 2.

$$I_D = I_{D1} + I_{D2} + I_{D3} - \frac{V_D}{R_{L1}} \tag{2}$$

where $I_{D2}$ denotes a level of a sink current when the constant-current circuit 32 is turned on, and $I_{D3}$ is a level of a sink current when the constant-current circuit 33 is turned on. $V_D$ denotes a plasma discharge voltage (i.e., a voltage applied to electrodes in plasma chambers) based on a constant-current circuit method. $V_D$ has a value including a voltage drop due to internal resistances of the anode electrodes 20 and the cathode electrodes 21. $R_{L1}$ denotes a load resistance.

Figure 2:
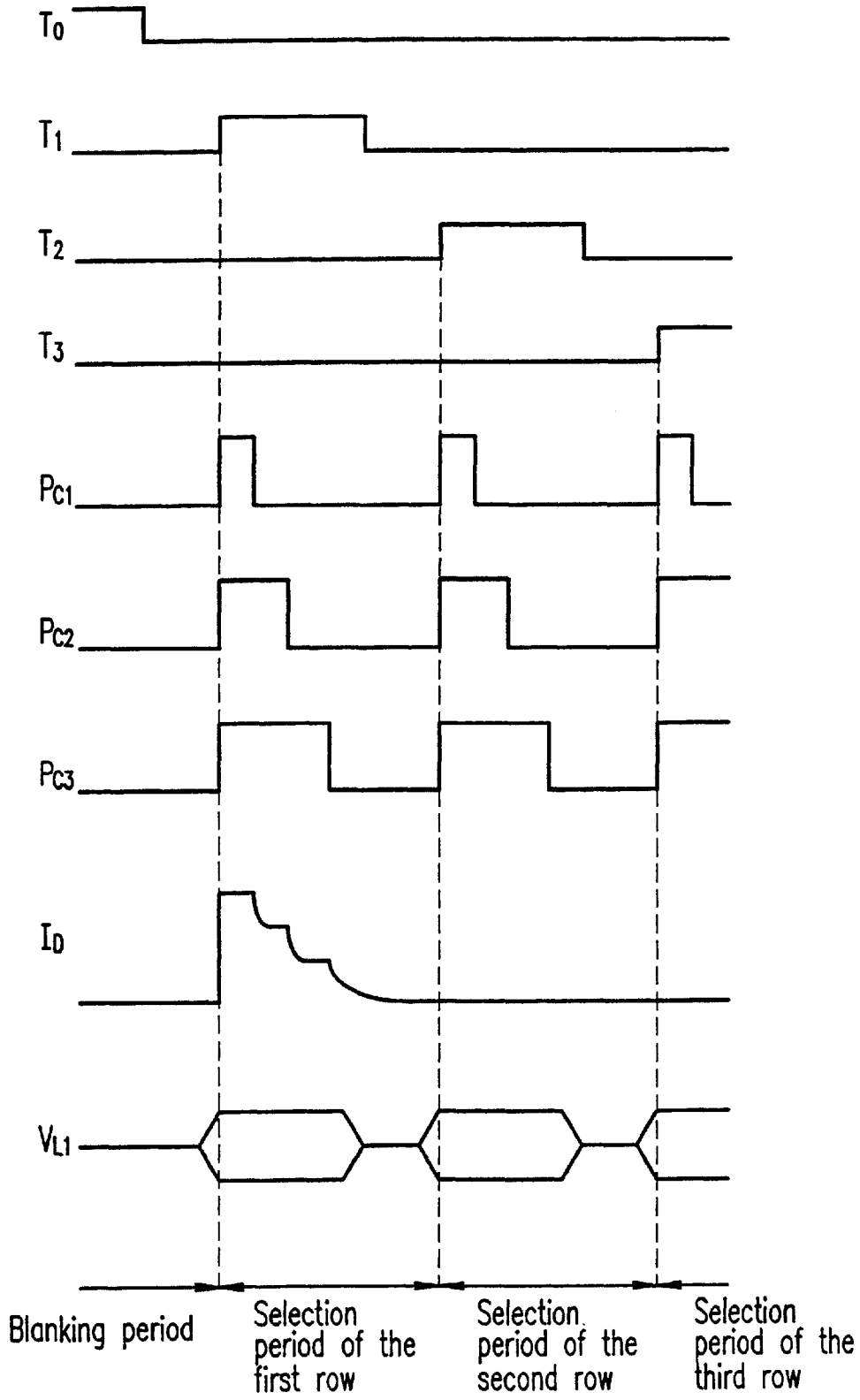
FIG. 2 is a timing chart for driving a plasma address display apparatus in Embodiment 1.

Next, driving of the plasma address display apparatus in the present embodiment will be described with reference to FIG. 2. FIG. 2 is a timing chart showing the gate voltages of the switching transistors $T_0$, $T_1$, $T_2$, and $T_3$, the voltages of the input terminals $P_{C1}$, $P_{C2}$, and $P_{C3}$ input to the constant-current circuits 31, 32, and 33, respectively. A voltage applied to the signal electrode $VL_1$, and a level of the discharge current $I_D$ flowing through the plasma chamber in the first row.

First, only the switching transistor $T_o$ is turned on during a blanking period, and the other switching transistors are all turned off. At this time, currents of three constant-current circuits 31, 32, and 33 are bypassed to the anode electrodes 20 only via the switching transistor $T_0$.

Next, the switching transistor $T_0$ is turned off, and only the switching transistor $T_1$ is turned on. Simultaneously with this, all the constant-current circuits 31, 32, and 33 are turned on. At this time, a discharge current flowing through the plasma chamber in the first row assumes a value represented by Formula 2.

Then, one of the constant-current circuits (e.g., 31) is turned off, whereby the discharge current $I_D$ is slightly decreased. One of the constant-current circuits (e.g., 32) in the ON state is turned off, whereby the discharge current $I_D$ is further decreased. Finally, all the constant-current circuits are turned off, whereby the discharge current $I_D$ is approximated to 0.

As described above, by gradually decreasing a current flowing through the plasma chamber by using the constant-current circuit during a selection period of the first row, a decay time can be easily shortened.

Even after the switching transistor $T_1$ is turned off and the switching transistor $T_2$ is turned on, by controlling the constant-current circuit in the same way, a current flowing through the plasma chamber in the second row can be gradually decreased, whereby the decay time can be shortened.

Next, the relationship between the discharge current and the decay time of decay voltage immediately before the finish of the plasma discharge is examined. The decay time of decay voltage $\tau$ herein is defined as a period from the time when the plasma discharge is finished to the time when a data voltage applied to the signal electrode is reset. A 5% decay refers to a decay time of decay voltage when a charge held by the liquid crystal layer changes by 5% during a period from the time when a signal voltage is reset to a voltage in a range of a blanking level to a black level after finishing discharge to the time immediately before the pixels are selected again. A 10% decay refers to a decay time of decay voltage when a charge held by the liquid crystal layer changes by 10% during a period from the time when a signal voltage is reset to a voltage in a range of a blanking level to a black level after finishing discharge to the time immediately before the pixels are selected again.

Figure 6:
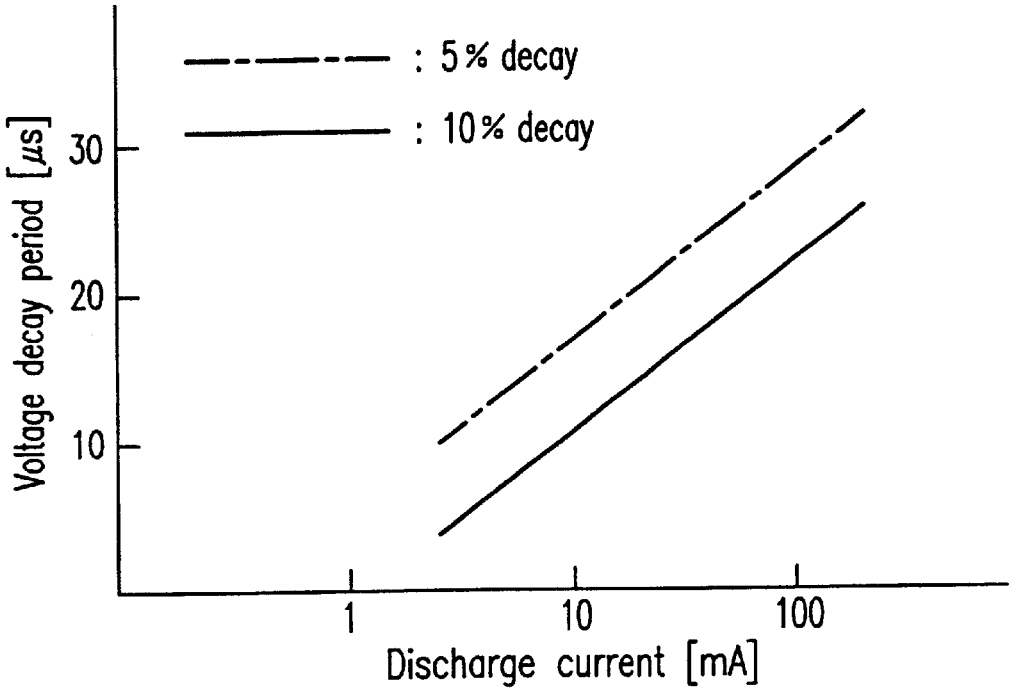
FIG. 6 is a graph showing the relationship between the discharge current and the decay time.

FIG. 6 shows the results. It is understood from the graph that as a discharge current immediately before the finish of the plasma discharge is reduced as much as possible, the decay time of decay voltage $\tau$ can be reduced to a small value.

More specifically, the resistor $R_{11}$ of the constant-current circuit 31 is set at about 68 Ω, and the resistors $R_{12}$ and $R_{13}$ thereof are both set at about 56 Ω, and a sink current of the constant-current circuit 31 is set at about 84 mA; the resistor $R_{21}$ of the constant-current circuit 32 is set at about 150 Ω, and the resistors $R_{22}$ and $R_{23}$ thereof are both set at about 120 Ω, and a sink current of the constant-current circuit 32 is set at about 34 mA; the resistor $R_{31}$ of the constant-current circuit 33 is set at about 100 Ω, and the resistors $R_{32}$ and $R_{33}$ thereof are both set at about 56 Ω, and a sink current of the constant-current circuit 33 is set at about 65 mA; an ON time of the constant-current circuit 31 is set at about 2 μs; an On time of the constant-current circuit 32 is set at about 4 μs; and an ON time of the constant-current circuit 33 is set at about 6 μs. At this time, a discharge current in the plasma chamber while only the constant-current circuit 33 is turned on is about 5 mA, and a current flowing through the load resistor $RL_1$ is about 60 mA. At this time, a 10% decay time is measured to be about 7 μs or less.

Embodiment 2

The second embodiment of the present invention will be described below.

Figure 3:
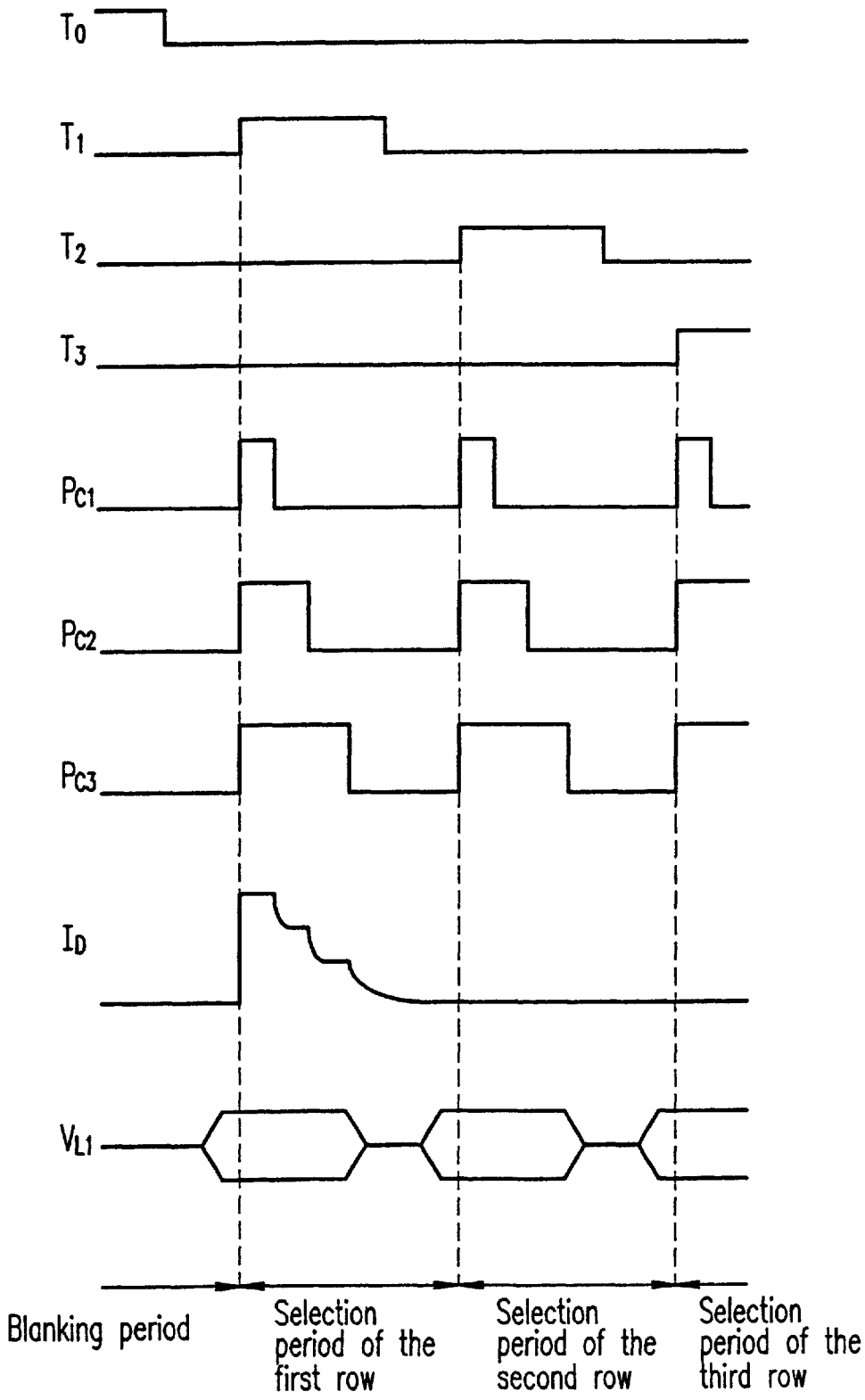
FIG. 3 is a timing chart for driving a plasma address display apparatus in Embodiment 2.

Although the circuit configuration of a plasma address display apparatus in the present embodiment is identical with that in Embodiment 1, they are different in the driving method. FIG. 3 is a timing chart showing a driving method in Embodiment 2. This timing chart shows the gate voltages of the switching transistors $T_0$, $T_1$, $T_2$, and $T_3$, the voltages of the input terminals $P_{C1}$, $P_{C2}$, $P_{C3}$, and $P_{C4}$ input to the constant-current circuits 31, 32, and 33, respectively, a voltage applied to the signal electrode (opposite electrode) $VL_1$, and a level of the discharge current $I_D$ flowing through the plasma chamber in the first row.

As is understood from FIG. 3, according to the method for driving the plasma address display apparatus in the present embodiment, the timing at which a voltage starts being applied to the signal electrode (opposite electrode) $VL_1$ is set slightly earlier than the timing at which a selection period of the plasma chamber starts.

Typically, when the timing at which a data voltage is applied comes earlier than the timing at which a selection period starts, the data voltage is applied to a pixel in the plasma chamber in the previous row. However, in the case where the decay time can be controlled to be short, even when the timing at which a data voltage is applied comes earlier than the timing at which a selection period starts, no problem arises as long as the timing at which a data voltage is applied comes after the completion of a decay time of the plasma chamber in the previous row. Because of this, a data voltage can be written in each pixel at a high speed, and sufficient writing can be performed even in a display apparatus with a high precision in which a selection period is shortened.

In the above-mentioned embodiments, the case where three constant-current circuits are used to switch a discharge current to four values has been described. However, it is also possible to use two constant-current circuits to switch the discharge current to three values. Alternatively, it is possible to use four or more constant-current circuits to switch a discharge current to five or more values. In order to shorten the time up to the finish of plasma discharge, the number of constant-current circuits is preferably smaller, and in order to gradually decrease a discharge current, the number of switched current values is preferably larger. Therefore, the number of constant-current circuits to be used is preferably two or three. Furthermore, in order to stabilize plasma discharge in the plasma chamber, a period for controlling each discharge current is desirably set at about 2 $\mu$s.

Embodiment 3

Figure 4:
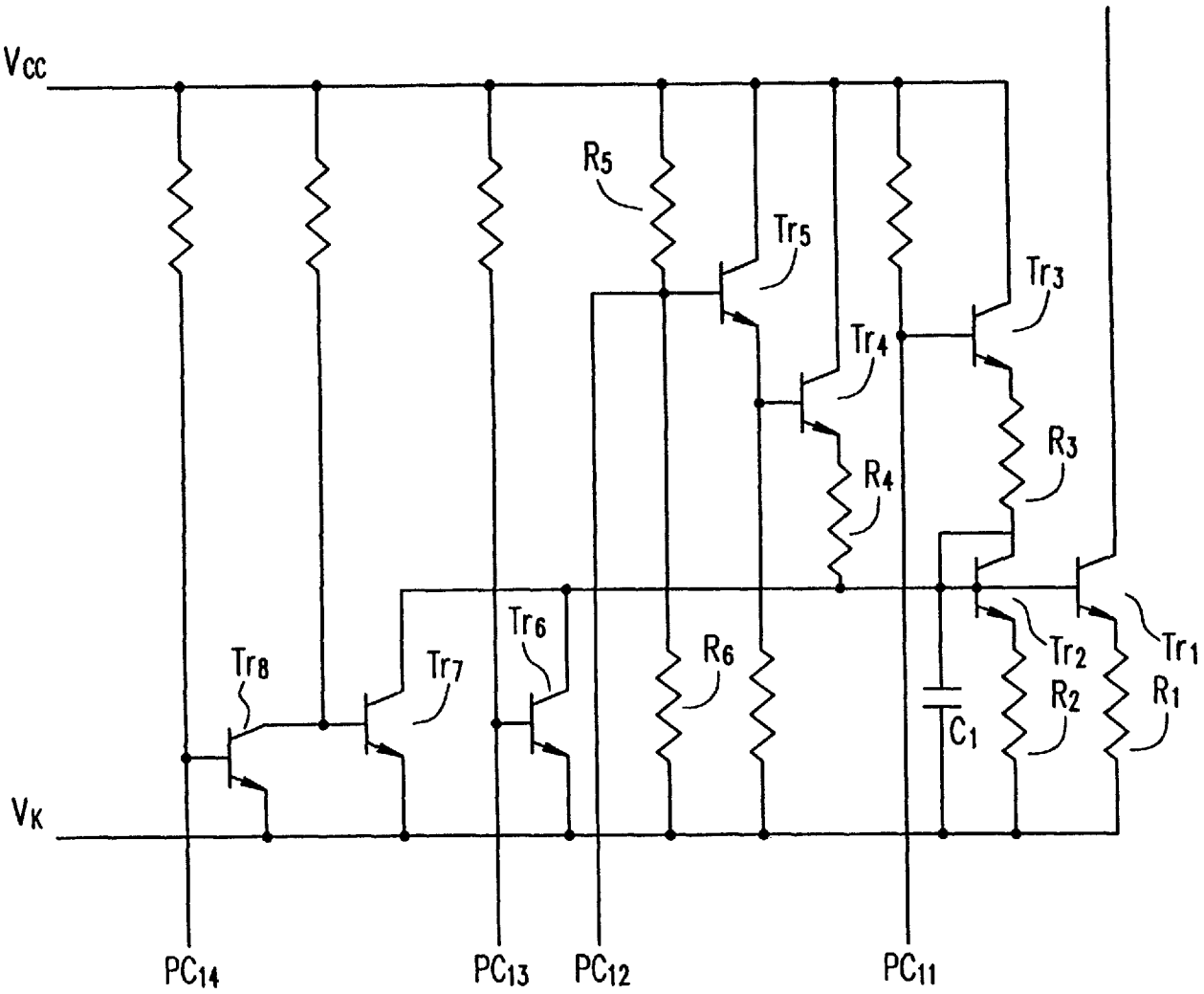
FIG. 4 schematically shows a configuration of a discharge current control circuit of a plasma address display apparatus in Embodiment 2.
Figure 5:
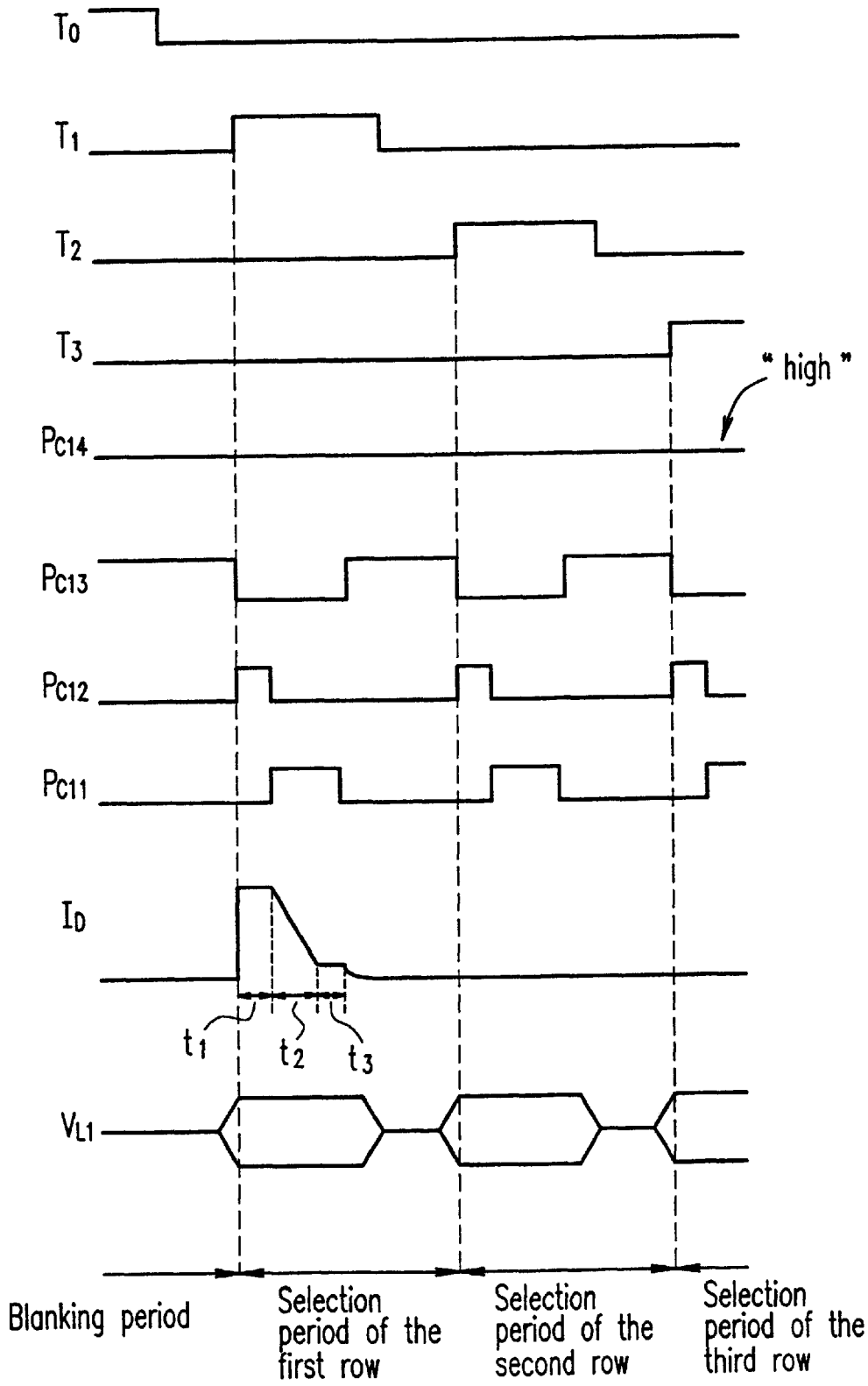
FIG. 5 is a timing chart for driving the plasma address display apparatus in Embodiment 3.

The discharge current may be attenuated in the form of slopes, as well as changed in the form of steps. FIG. 4 is a schematic diagram showing a configuration of a discharge current control circuit in a plasma address display apparatus in Embodiment 3 of the present invention. FIG. 5 is a timing chart showing driving of the plasma address display apparatus.

The discharge constant-current circuit shown in FIG. 4 has a current mirror circuit structure in which, among NPN transistors $T_{r1}$ and $T_{r2}$ whose bases are commonly connected, the collector of the NPN transistor $T_{r1}$ becomes a terminal of constant sink current output, the base of the NPN transistor $T_{r2}$ is connected to the collector of the NPN transistor $T_{r2}$, and emitters of the NPN transistors $T_{r1}$ and $T_{r2}$ are connected to the voltage of cathode electrodes through two resistors $R_1$ and $R_2$ having different resistances, whereby a constant sink current is independently controlled to two values by two resistors $R_3$ and $R_4$ connected to the bases of the NPN transistors $T_{r1}$ and $T_{r2}$.

Furthermore, a capacitance $C_1$ is connected between the base of the NPN transistor $T_{r2}$ and the voltage of the cathode electrodes, whereby a change in a constant sink current is controlled in the form of slopes. The collector of the NPN transistor $T_{r1}$ is connected to the switching transistors $T_0$ to $T_n$ shown in FIG. 1.

The discharge current control circuit shown in FIG. 4 has four terminals $PC_{11}$ to $PC_{14}$. During a normal operation, either one of the terminals $PC_{13}$ and $PC_{14}$ can turn off the discharge current control circuit. As a result of providing two terminals $PC_{13}$ and $PC_{14}$, the control portions of the terminals $PC_{11}$ and $PC_{12}$ are supplied with the operation voltage during power-up and each of the voltages of the terminals $PC_{11}$ and $PC_{12}$ reaches a low level. During this period, the transistor $T_{r1}$ of the current mirror circuit is prevented from becoming an operation state, and the transistor $T_{r1}$ is maintained in an OFF state, whereby the discharge current control circuit is prevented from allowing an error current to flow. Even if the terminals $PC_{13}$ and $PC_{14}$ are both "HIGH" or both "LOW", the NPN transistor $T_{r1}$ is turned off.

Next, driving of the plasma address display apparatus in the present embodiment will be described with reference to FIGS. 4 and 5. FIG. 5 is a timing chart showing the gate voltages of the switching transistors $T_0$, $T_1$, $T_2$, and $T_3$, the voltages of the terminals $PC_{11}$, $PC_{12}$, $PC_{13}$, and $PC_{14}$ of the discharge current control circuit, the voltage applied to the signal electrode $VL_1$, and the level of the discharge current $I_D$ flowing through the plasma chamber in the first row. In the present embodiment, the control terminal $PC_{14}$ is always held at a high level, and controls the terminal $PC_{13}$.

First, only the switching transistor $T_0$ is turned on during a blanking period, and the other switching transistors are all turned off. At this time, the current of the discharge current control circuit is bypassed to the anode electrodes only via the switching transistor $T_0$.

Next, the switching transistor $T_0$ is turned off, and only the switching transistor $T_1$ is turned on. Simultaneously with this, the terminal $PC_{13}$ is turned low, and the terminal $PC_{12}$ is turned high. At this time, the NPN transistor $T_{r6}$ is turned off, and the NPN transistors $T_{r4}$ and $T_{r5}$ are turned on. Therefore, the capacitance $C_1$ is charged, and the NPN transistor $T_{r1}$ is turned on, thereby sinking an electric current. A sink current $I_{P1}$ at this time is represented by Formula 3. In order to stabilize the discharge in the plasma chamber, this state is desirably held for a period of about 2 $\mu$s. In FIG. 5, this period is represented by $t_1$.

$$I_{P1} = \left(\frac{(V_{CC} - V_K) * R_6}{R_5 + R_6} - 3V_{BE}\right) \times \frac{R_2}{R_1(R_2 + R_4)} \tag{3}$$

Next, when the terminal $PC_{12}$ is turned low and the terminal $PC_{11}$ is turned high, the NPN transistor $T_{r4}$ is turned off, and the NPN transistor $T_{r3}$ is turned on. As a result, the capacitance $C_1$ is discharged, and the sink current $I_{P1}$ is changed in the form of slopes over a predetermined period. In FIG. 5, this period is represented by $t_2$.

When discharge is finished, the sink current $I_{P1}$ is stabilized to be a current value represented by Formula 4. In order to stabilize the discharge in the plasma chamber, this state is desirably held for a period of about 2 $\mu$s. In FIG. 5, this period is represented by $t_3$.

$$I_{P1} = \frac{(V_{CC} - V_K - 2V_{BE}) * R_3}{(R_2 + R_3) * R_1} \tag{4}$$

Next, the terminal $PC_{11}$ is turned low, and the terminal $PC_{13}$ is turned high to turn off the sink current $I_{P1}$. In this manner, writing and holding in the first row are completed. The switching transistor $T_1$ is turned off, and thereafter, the switching transistor $T_2$ is turned on, whereby writing in the second row starts, and the similar operation is repeated.

The capacitance $C_1$ can lower the impedance between the base of the NPN transistor $T_{r1}$ and the voltage of the cathode electrodes in high frequency, so that the capacitance $C_1$ also has a function of noise canceling.

In Embodiment 3, the timing at which a voltage is applied to the signal electrode (opposite electrode) VL may be set earlier than the timing at which a selection period of a plasma chamber starts in the same way as in Embodiment 2.

More specifically, when the discharge current control circuit is operated under the condition that the resistors $R_1$, $R_2$, $R_3$, $R_4$, $R_5$, and $R_6$ are set at about 1.5 KΩ, about 8.2 KΩ, about 100 Ω, about 5.6 KΩ, and about 6.0 KΩ, respectively, and the capacitance $C_1$ is set at about 56,000 PF, the sink current during the discharge period $t_1$ becomes about 180 mA. Furthermore, the sink current during the discharge period $t_3$ is about 73 mA, among which a current flowing through the resistors RL can be set at about 65 mA, and a discharge current can be set at about 8 mA. Furthermore, the discharge period of the capacitance $C_1$ is about 2 μs, and a 10% decay can be set at about 9.5 μs.

In the above-mentioned third embodiments, when the discharge current is varied, as the value of the discharge current to be eventually controlled is decreased, the decay time can be further shortened. However, if the value of the discharge current is too small, discharge is not stabilized. Therefore, the value of the discharge current is desirably set at about 5 to 10 mA.

Furthermore, the discharge current to be first controlled immediately after the commencement of discharge may be increased to such a degree that arc discharge is not generated in the plasma chamber.

Furthermore, in the above-mentioned third embodiments, the discharge current is controlled by the discharge current control apparatus having a constant-current circuit and a current mirror circuit. However, the discharge current may be controlled by controlling a voltage applied to the cathode electrodes.

Furthermore, the constant-current control apparatus is not limited to use for a driving device in a plasma address display apparatus. The constant-current control apparatus may be used in any electronic circuit. In addition, transistors used in the constant-current control apparatus are not limited to NPN transistors. PNP transistors or MOS transistors may be used.

Embodiment 4

The fourth embodiment of the present invention will be described below.

In Embodiment 4, the discharge current is controlled by controlling the voltage applied to cathode electrodes.

Figure 7:
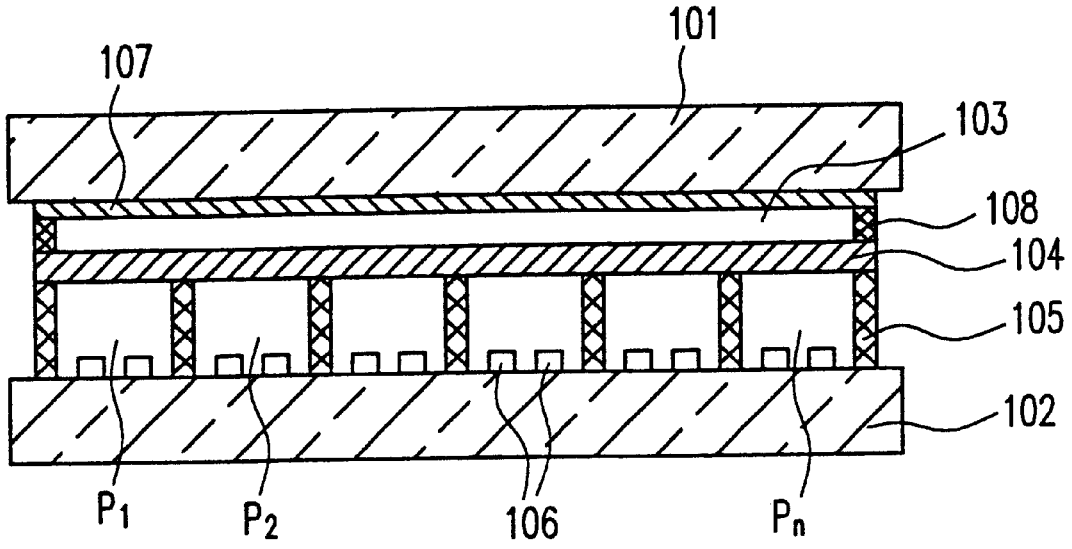
FIG. 7 is a cross-sectional view of a plasma address display apparatus.
Figure 8:
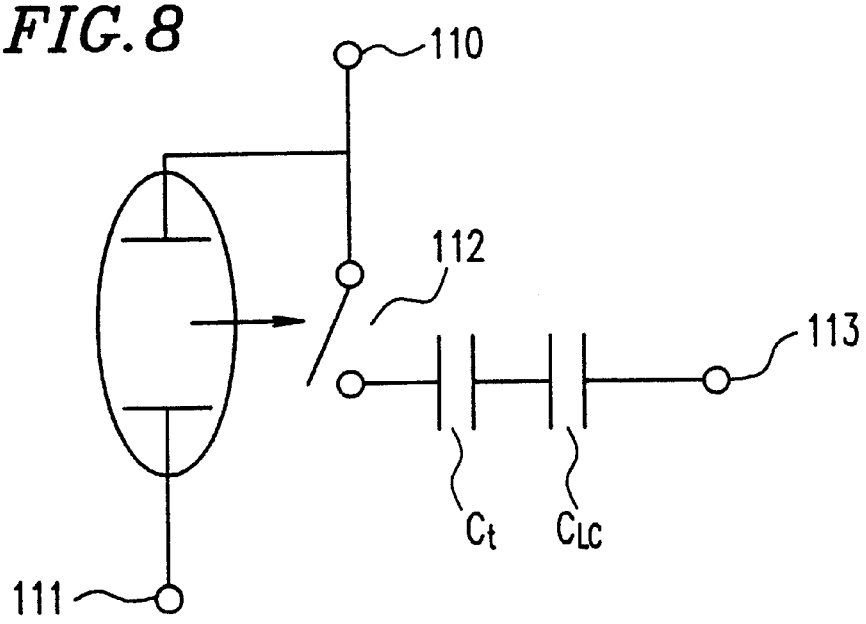
FIG. 8 is a schematic view showing a circuit configuration with respect to each pixel in a plasma address display apparatus.
Figure 9:
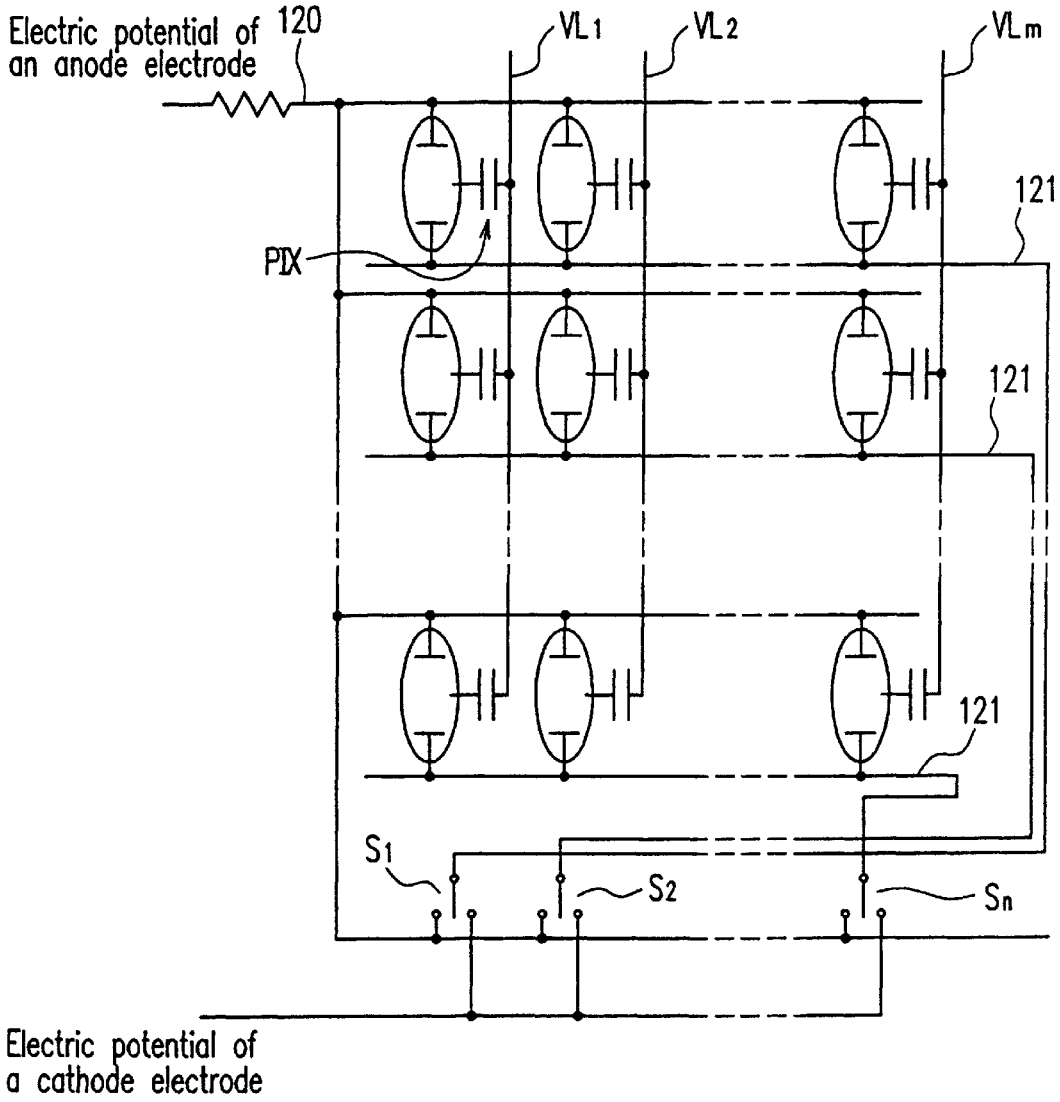
FIG. 9 is a schematic circuit diagram of a conventional plasma address display apparatus.
Figure 11:
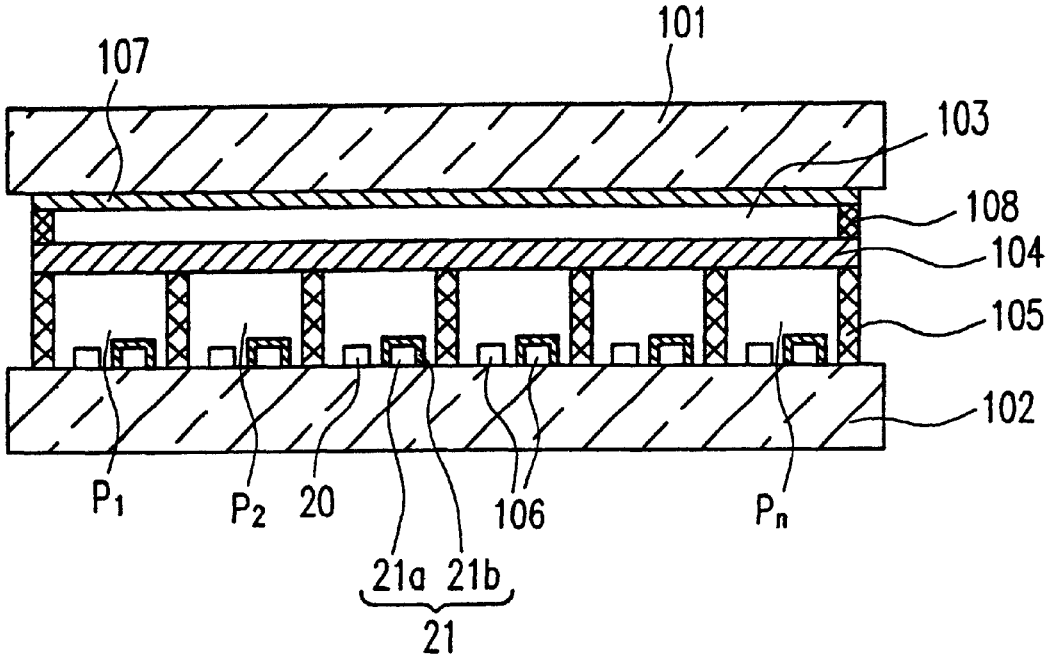
FIG. 11 is a cross-sectional view of the plasma address display apparatus in Embodiment 4.

FIG. 11 is a cross-sectional view showing a plasma address display apparatus in the present embodiment. The cross-sectional structure shown in FIG. 11 is the same as that shown in FIG. 7, except for the structure of the cathode electrodes 21.

In the present embodiment, the resistance of resistors $R_{CS}$ is specified, which are arranged in series in a discharge path of a high resistance layer of the cathode electrodes 21.

Anode electrodes 20 and the cathode electrodes 21 are formed in parallel to the row direction in plasma chambers $P_1$ to $P_s$ corresponding to a certain scanning line on a glass substrate 102. The anode electrode 20 has a single low resistance layer. The cathode electrode 21 has a low resistance layer 21*a* and a high resistance layer 21*b* formed on the low resistance layer 21*a*.

Figure 10:
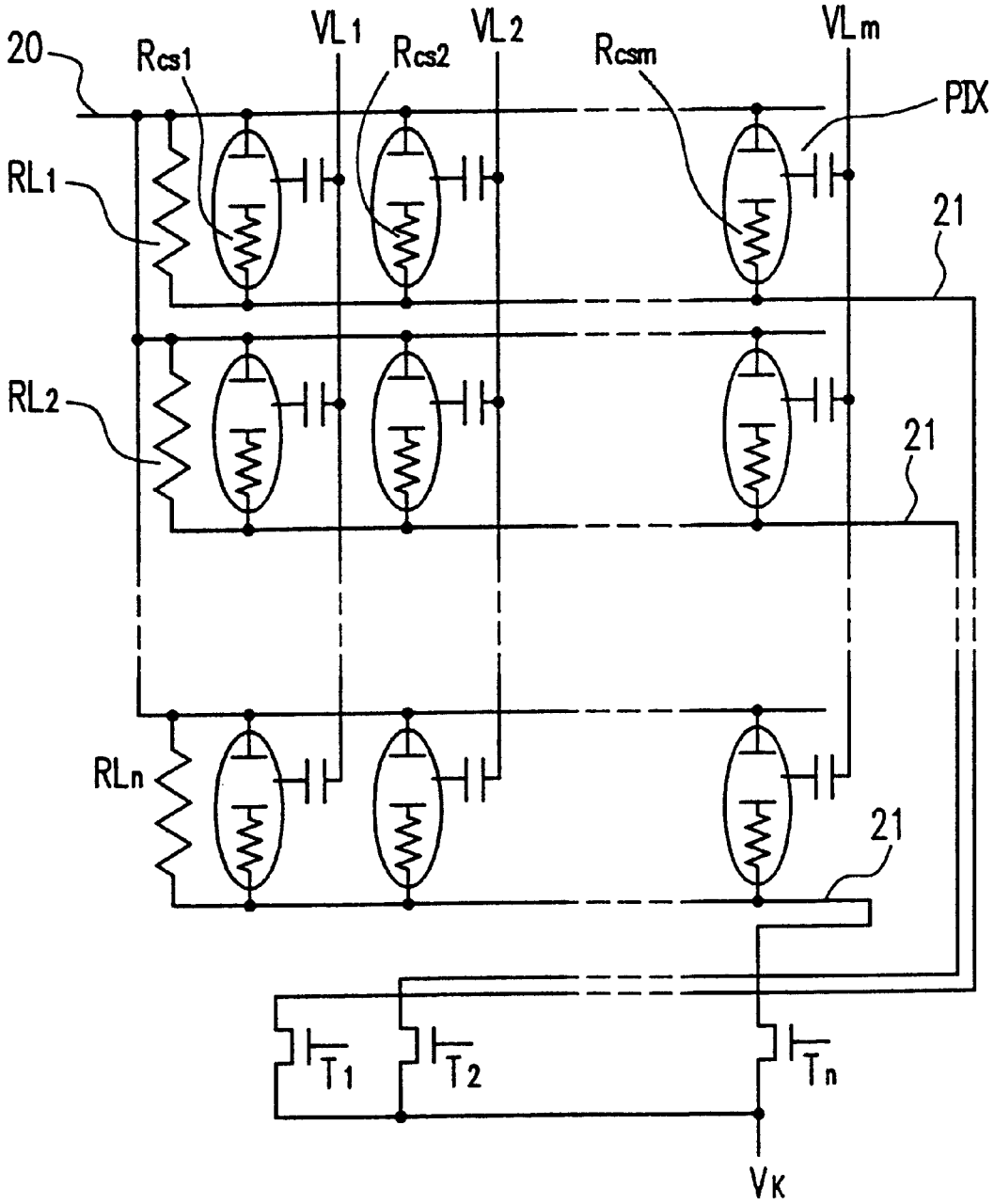
FIG. 10 is a schematic circuit diagram of a plasma address display apparatus in Embodiment 4.

FIG. 10 schematically shows a circuit configuration of the plasma address display apparatus in the present embodiment.

In the plasma address display apparatus in the present embodiment, a cathode voltage $V_X$ is applied to sources of switching transistors $T_1$ to $T_s$. In this manner, by directly controlling the cathode voltage $V_X$, the constant-current circuits used in the discharge current control circuit in the plasma address display apparatus (FIG. 1) in Embodiment 1 are no longer required. Furthermore, the switching transistor $T_0$ is no longer required.

Furthermore, in the plasma address display apparatus of the present embodiment, resistors $R_{CSi}$ (i=1, 2, . . . , m) are inserted in series in a discharge path on the cathode side of display pixels PIX. The resistors $R_{CSi}$ (i=1, 2, . . . , m) are ones representing the resistance of the high resistance layer 21*b* formed on the cathode electrode 20 in FIG. 11 in the form of distributed constants. The relationship between the resistance of the resistor $R_{CS}$ per one scanning line and the resistance of the resistor $R_{CSi}$ (i=1, 2, . . . , m) is represented by Formula 5.

$$1/R_{CS}=1/R_{CS1}+\ldots+1/R_{CSK} \tag{5}$$

The relationship between the discharge current $I_D$ and the cathode voltage $V_K$ is represented by Formula 6.

$$V_X=V_D(ave)+I_D\cdot R_{CS} \tag{6}$$

$V_D$(ave): Dropped voltage due to the plasma discharge from the surface to the plasma chambers of the anode electrodes 20 to the surface of the cathode electrodes 21, which is an average voltage of the voltage $V_D$ based on a voltage control method in each pixel. $V_D$(ave) has a value which does not include a voltage drop due to the internal resistances of the anode electrodes 20 and the cathode electrode 21.

In the present embodiment, the resistance of the resistor $R_{CS}$ is set at about 360 Ω. Because of this, it is possible to provide a cathode control voltage range $\Delta V_K$ with a voltage gradient of about 50 volts or more at the discharge current in a range of about 0 mA to about 135 mA. Thus, the discharge current can be controlled by controlling the voltage applied to the cathode electrodes.

When the resistance of the resistor $R_{CS}$ is decreased, the cathode control voltage $\Delta V_K$ becomes narrow. Therefore, a more exact cathode voltage needs to be applied. Furthermore, the function of returning a suddenly changed discharge current to the original current becomes weak in a region of the plasma chamber having a low impedance. Thus, $R_{CS} \geqq 120$ Ω is desirable.

In contrast, when the resistance of the resistor $R_{CS}$ is increased, the cathode control voltage range $\Delta V_K$ becomes wide; however, a voltage $V_K$ applied to the cathode electrodes increases. Thus, $R_{CS} \leqq 680$ Ω is desirable.

In the same way as in Embodiments 1 and 2, the discharge current to be controlled may be switched to four values. Alternatively, the discharge current may be controlled to three values or five or more values. Furthermore, in the same way as in Embodiment 3, the discharge current may be switched in the form of slopes. According to any of these methods, for example, a period $t_3$ during which a discharge current having the second value from the last flows is desirably about 2 μs or more, as shown in FIG. 5.

The low resistance layer of the anode electrode 20 and the low resistance layer 21*a* of the cathode electrode 21 are formed by a printing method, for example, using a Ni material. The high resistance layer 21*b* of the cathode electrode 21 is formed by a printing method, for example, using a mixture of powders of an insulating material and a conductive material $LaB_6$. In the mixture, a grain diameter of the insulating material is decreased so that the insulating material is uniformly distributed. As the insulating material, a material having a large resistance component and a low capacitance component (low dielectric constant) is desirable.

As described above, the plasma address display apparatus of the present invention has a discharge current control circuit which switches a discharge current flowing through the plasma chamber to at least three values. Therefore, a decay time can be easily controlled. The discharge current may be controlled by using a constant-current circuit or by controlling a voltage applied to cathode electrodes.

Furthermore, the timing at which a desired data voltage starts being applied to the signal electrode is set before the timing at which a plasma chamber where pixels for writing the data voltage are switched starts being discharged. Thus, it becomes possible to write a data voltage in each pixel at a high speed, and the time required for writing a data voltage can be shortened.

In particular, in the case where a decay time is controlled, and a selected plasma chamber is set in an insulated state before the completion of a selection period, even if the timing at which a data voltage is applied to the signal electrode comes before the timing at which a selection period of a pixel in which the data voltage is written, the data voltage can be written at a high speed without being written in a pixel of the previous row, and a normal display can be obtained even in a high-precision panel with a shorter selection period.

Furthermore, by combining a plurality of constant-current control circuits which can be independently controlled, the above-mentioned discharge current control circuit can be easily constructed.

Furthermore, it is also possible to control a discharge current by using a current mirror circuit as in the constant-current control apparatus of the present invention. In this case, by providing a sufficient difference in resistance between the third and fourth resistors, in the case where a "HIGH" signal is applied to both the third and fourth resistors, the current mirror circuit can be controlled, giving a priority to a signal with a low resistance.

Furthermore, by providing a capacitance component between the base of the second transistor and the first power supply line in the constant-current control apparatus, the capacitance component is capable of canceling a noise voltage in a constant-current control circuit.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A plasma address display apparatus, comprising:

a plasma substrate on which a plurality of plasma chambers are arranged in rows, the plasma chambers including at least an anode electrode and a cathode electrode;

an opposite substrate on which a plurality of signal electrodes are arranged in columns; and a liquid crystal layer provided between the plasma substrate and the opposite substrate, wherein the plurality of plasma chambers are selectively discharged and a desired data voltage is selectively applied to the plurality of signal electrodes, whereby a desired display is performed, the apparatus further comprising a discharge current control circuit for switching a discharge current flowing through the plasma chambers to at least three values of a first discharge current at the commencement of plasma discharge, a second discharge current immediately before the finish of plasma discharge, and a third discharge current after the finish of plasma discharge.

2. A plasma address display apparatus according to claim 1, wherein the discharge current control circuit has at least one constant-current circuit, and the discharge current is controlled by using the at least one constant current circuit.

3. A plasma address display apparatus according to claim 1, wherein the discharge current is controlled by controlling a voltage applied to the cathode electrodes.

4. A plasma address display apparatus according to claim 1, wherein the discharge current control circuit controls a waveform of the discharge current in the plasma chambers in the form of steps.

5. A plasma address display apparatus according to claim 1, wherein the discharge current control circuit controls a waveform of the discharge current in the plasma chambers in the form of slopes.

6. A plasma address display apparatus according to claim 1, wherein a timing at which a desired data voltage starts being applied to the signal electrodes comes before a timing at which a plasma chamber where pixels for writing the data voltage are switched starts being discharged.

7. A constant-current control apparatus for controlling a discharge current flowing through a plasma display, comprising a plurality of constant-current circuits, each constant-current circuit having a control terminal which is independent from each other constant-current circuit's control terminal, and wherein sink current terminals of the constant-current circuits are commonly connected, and each of the control terminals is independently controlled to apply a separate signal to its corresponding constant-current circuit to control turning the circuit on and off.

8. A constant-current control apparatus comprising a current mirror circuit having first and second transistors whose bases are connected to each other, in which an emitter of each of the first and second transistors is connected to a first power supply line through first and second resistors, and a collector of the second transistor is connected to the base of the second transistor, wherein third and fourth resistors having different resistances are connected in parallel to the base of the second transistor in the current mirror circuit, and a voltage alternatively applied to the third and fourth resistors is controlled by first and second terminals independent from each other, whereby a collector current of the first transistor in the current mirror circuit is varied.

9. A constant-current control apparatus according to claim 8, wherein a capacitance component is provided between the base of the second transistor and the first power supply line.

* * * * *